US005928543A

United States Patent [19]

Davis et al.

[11] Patent Number: 5,928,543

[45] Date of Patent: Jul. 27, 1999

[54] COOKTOP AND HEATING ELEMENT THEREFOR

[75] Inventors: Kenneth L. Davis, Dayton; Donald L. Eirich, Marysville, both of Ohio

[73] Assignee: Whirlpool Corporation, Benton Harbor, Mich.

[21] Appl. No.: 08/909,019

[22] Filed: Aug. 11, 1997

Related U.S. Application Data

[60] Provisional application No. 60/033,664, Dec. 18, 1996.

[51] Int. Cl.[6] ..... H05B 3/68

[52] U.S. Cl. ..... 219/451.1; 219/454.12

[58] Field of Search ..... 219/443, 445, 219/447, 455, 456, 458, 463, 467

[56] References Cited

U.S. PATENT DOCUMENTS

| | | | |
|---|---|---|---|
| 2,547,058 | 4/1951 | Sutton | 219/458 |
| 2,667,564 | 1/1954 | Cunningham | 219/455 |
| 2,751,487 | 6/1956 | Vallorani et al. | 219/458 |
| 2,839,655 | 6/1958 | Price | 219/455 |
| 2,839,656 | 6/1958 | Weyrick | 219/458 |
| 3,016,444 | 1/1962 | Jasionowski | 219/458 |
| 4,388,519 | 6/1983 | Dooley | 219/463 |
| 4,974,804 | 12/1990 | Thompson et al. | 248/316.7 |

*Primary Examiner*—Teresa Walberg
*Assistant Examiner*—Sam Paik
*Attorney, Agent, or Firm*—Robert O. Rice; Joel M. Van Winkle; Andrea Powers Denklau

[57] ABSTRACT

The invention is a cooktop having a heating element that is locked in place and held in place by a biasing force to eliminate the rattle of the heating element during normal use and the dislodgement of the heating element during shipping. The heating element comprises a heating coil which is supported on a spider having multiple legs. The heating coils has two terminals which are connected to a receptacle block in the cooktop. The spider has a nose formed on the end of the legs. A biasing device is positioned between the cooktop and the heating coil, preferably a spring mounted to the electrical terminals and abutting the cooktop. The biasing device biases the nose of the spider into a keyway formed in the cooktop to wedge the nose into a locking position relative to the cooktop.

5 Claims, 4 Drawing Sheets

COOKTOP AND HEATING ELEMENT THEREFOR

This application claims the benefit of U.S. Provisional Application No. Ser. No. 60/033,664 filed on Dec. 18, 1996.

BACKGROUND OF THE INVENTION

1. Field of the Invention

The invention relates to a cooktop and more specifically to a heating element for a cooktop that can be fixed relative to the cooktop to prevent substantial rotational movement and vertical movement relative to the cooktop.

2. Description of the Related Art

In contemporary kitchens, cooktops are commonly used alone and in combination with an oven (a range) to provide multiple heating elements for preparing food. In electrical powered cooktops, the heating elements typically comprise an electrical heating coil supported by a spider, which is adapted to be received in an opening in the cooktop. Generally, a pan is disposed within the opening in the cooktop to serve as a collection area for spilled food. The pan has an opening through which two electrical terminals associated with the heating element pass and connect to a receptacle mounted to the underside of the cooktop. In this mounted position, the legs of the spider rest on an annular ledge formed in the pan.

This particular construction permits the heating element to move relative to the cooktop because the heating element merely rests on the pan. Also, the pan can move relative to the cooktop as it typically rests on the cooktop. The result is that a rattling noise often occurs when the user places a pan on the heating element. The rattling noise is perceived as an indicator of low quality to many users and it is desirable to eliminate the rattling. Also, during shipping, the containers holding the cooktop can be jostled sufficiently so that the heating element can dislodge itself from the receptacle. Therefore, it is desirable to prevent vertical movement of the heating element.

Previous cooktop constructions have provided for a retaining clamp mounted on the cooktop and extending through an opening in the pan for holding one leg of the spider. The retaining clamp initially sufficiently holds one leg of the spider to prevent movement of the heating element within the plane of the cooktop. However, through continued use of the cooktop, the connection between the clip and the cooktop develops sufficient slack so that the heating element can begin to move and rattles when a pan is place thereon. Also, the pan can move relative to the cooktop, resulting in a rattle. Further, the clip typically does not hold the leg of the spider with sufficient force to prevent it from being sprung out from the jostling of the shipping container.

Another solution was to form a slot in the side wall of the pan and permit the end of one leg of the spider to fall within the slot. To insure that the end of the spider could be received within the slot, the slot was appropriately oversized, which permitted the movement of the heating element in the plane of the cooktop. More importantly, the slot did not prohibit the vertical movement of the heating coil.

SUMMARY OF THE INVENTION

The invention solves the problem associated with previous heating element holding mechanisms by prohibiting the movement of the heating element in the plane of the cooktop and prohibiting the vertical movement of the heating element relative to the cooktop. The invention is an electric cooktop with a locking heating element that comprises a key, which is sized to be received within a keyway formed in the cooktop. A biasing device is disposed between the heating element and the cooktop to bias the key into the keyway whereby the heating element is locked in place to prevent rotational and vertical movement thereof relative to the cooktop.

Preferably, the heating element includes a heating coil, which is supported on a spider having multiple legs, one of which terminates in a nose to form the key. The biasing device is a spring disposed between the heating coil and the cooktop. The biasing force of the spring is sufficient to wedge the upper surface of the nose within the keyway in the cooktop.

The nose forms an acute angle defined by the leading edge of the leg of the spider and the bottom edge of the leg of the spider. The angle of the nose can be selected so that the biasing force from the spring can be split between a direction in the plane of the cooktop and a vertical direction to control the proportion of the spring force that generally prohibits movement within the plane of the cooktop and vertical movement, respectively. Preferably, the acute angle is less than 60 degrees.

The spring is preferably a spring clip which is mounted to a retainer strap connecting two electrical terminals of the heating coil. The clip has a tang that is received within a detent in the retainer strap for a secure mounting and locating the clip relative to the heating coil. The electrical terminals are adapted to be received in an electrical receptacle mounted on the cooktop. In this position, the spring clip will abut the electrical receptacle to bias the nose into the keyway.

The keyway can be either an opening formed in the cooktop or the pan. Preferably, the keyway is an opening in both cooktop and the pan, which when aligned, form the keyway. The openings in the cooktop and the pan are preferably elongated to ease the insertion of the nose by a user when the heating element is mounted to the cooktop.

DESCRIPTION OF THE PREFERRED EMBODIMENT

Figure 1:
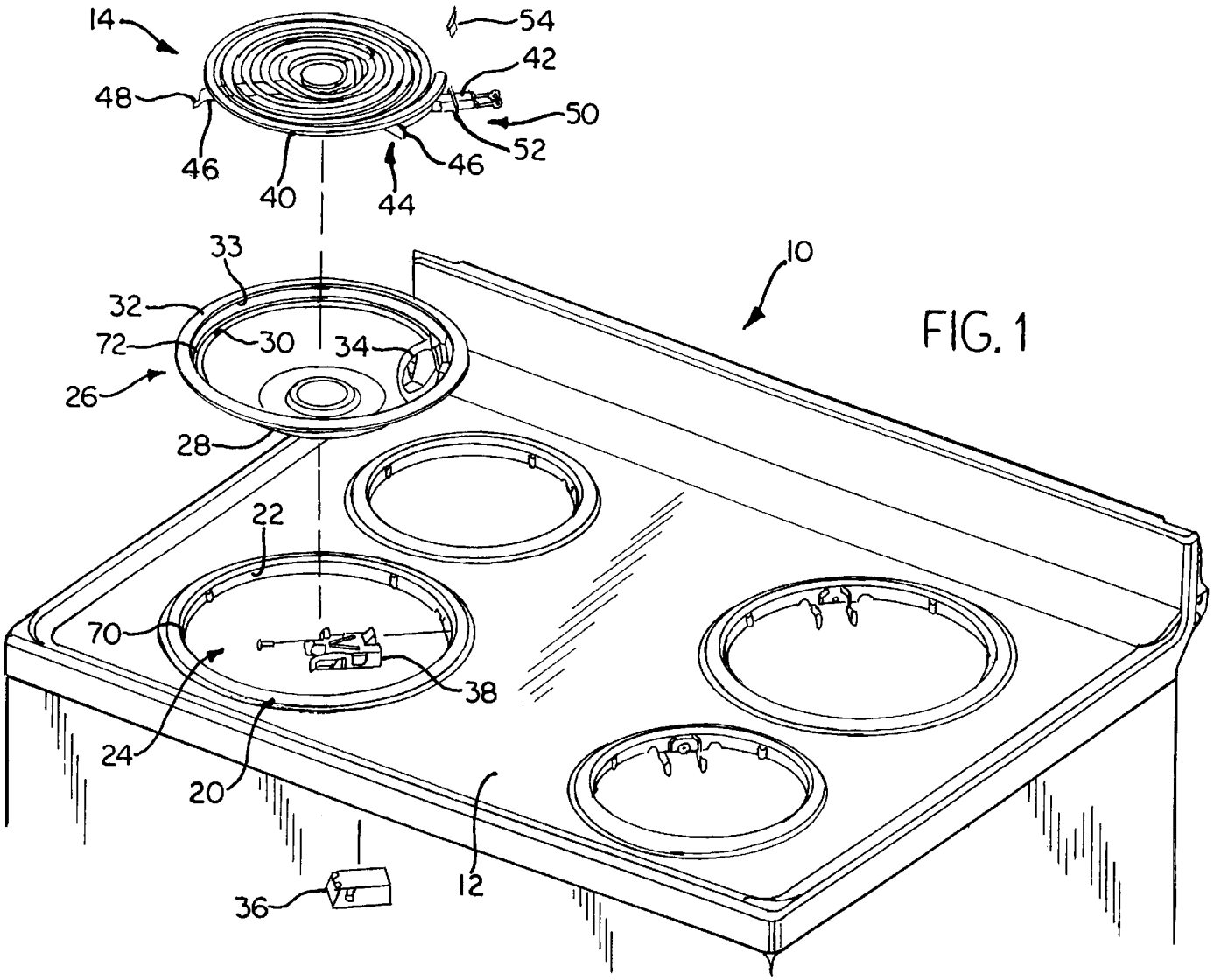
FIG. 1 is an exploded perspective view of a cooktop incorporating the heating element according to the invention.
Figure 2:
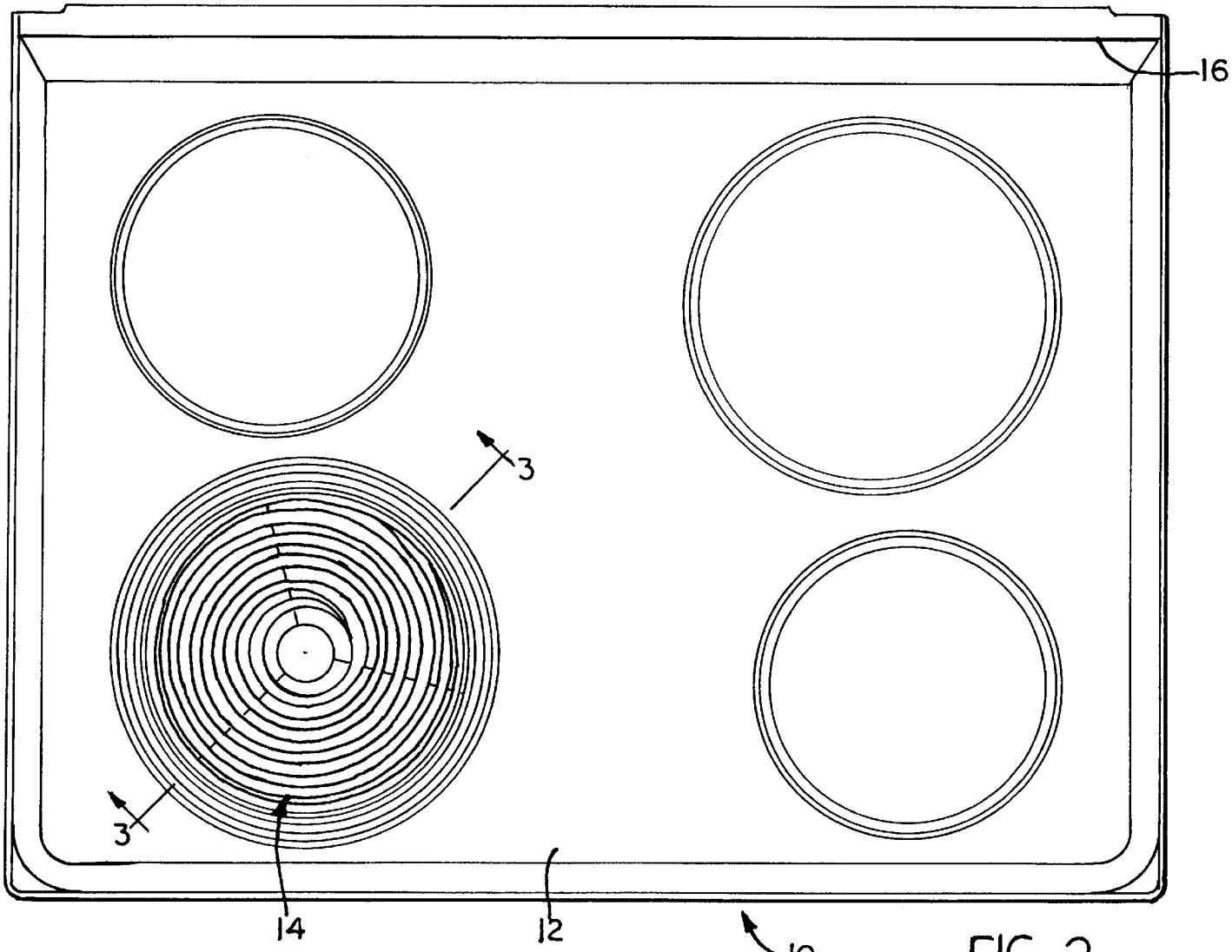
FIG. 2 is a top plan view of the cooktop of FIG. 1 with the heating element mounted to the cooktop.

FIGS. 1 and 2 illustrate a cooktop 10 according to the invention. The cooktop 10 has a planar top 12 on which is provided multiple heating elements 14 according to the invention. The cooktop 10 further comprises a control panel (not shown) controlling the operation of the heating elements 14. The construction of each of the heating elements is substantially identical. Therefore, only one of the heating elements 14 will be described in detail.

The cooktop 10 comprises an annular rim 20 rising above the planar top 12 and which has an annular lip 22, which defines a cooktop opening 24. A pan 26 is received within the cooktop opening 24. The pan 26 comprises a bowl 28 having an annular shoulder 30 connected to an annular lip 32 by an annular face 33. The bowl 28 of the pan 26 is received within the cooktop opening 24 and the annular lip 32 of the pan 26 rests on the annular rim 20 to mount the pan 26 to the cooktop 10.

Preferably, the bowl 28 further includes a receptacle opening 34 that provides access to a receptacle block 36, which is secured to the cooktop by a receptacle clip 38 securely fastened to the annular lip 22 of the cooktop. The receptacle block 36 is slideably mounted into the receptacle clip 38 in a well-known manner to mount the receptacle block to the cooktop 10. The receptacle block 36 is connected to an electrical power supply (not shown) in the conventional manner.

The heating element 14 is received within the cooktop opening 24 and disposed above the pan 26. The heating element 14 comprises a heating coil 40, which terminates in two electrical terminals 42 and which is supported by a spider 44 having multiple legs 46, one of which terminates in a key or nose 48.

A biasing device 50 comprising a retainer strap 52, connecting the two electrical terminals 42, and a spring clip 54 is mounted to the heating coil 40. The spring clip 54 is generally S-shaped and has a clip portion defined by a bent flange 56 and central web 58. The central web 58 has a detent 60 formed therein and which is received within an alignment opening in the retainer strap to secure and position the clip 54 to the strap 52. A spring arm 64 extends from the central web 58 beyond the clip portion.

Figure 3:
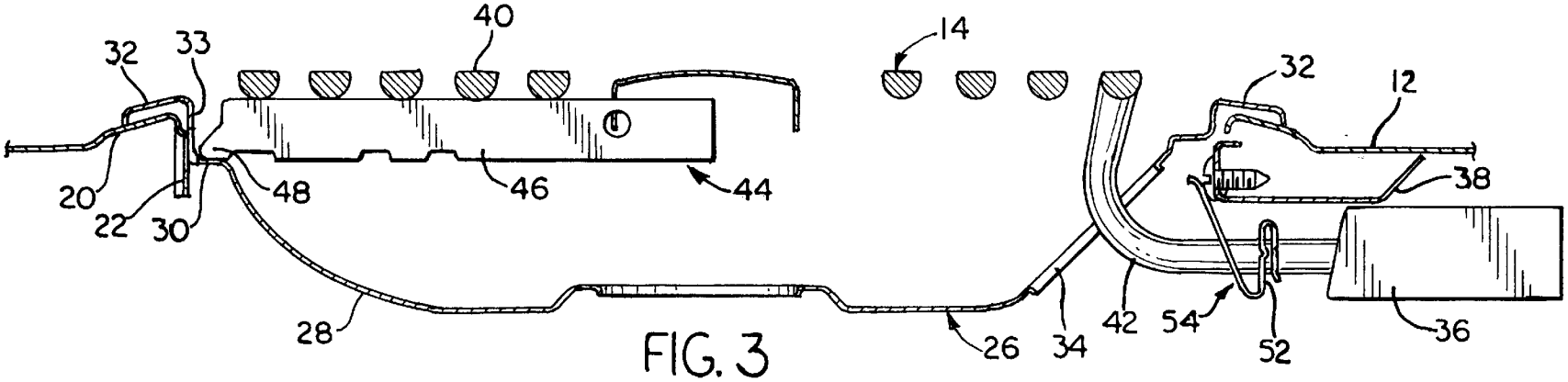
FIG. 3 is a sectional view taken along line 3—3 of FIG. 2, illustrating the heating element in an unlocked position.
Figure 4:
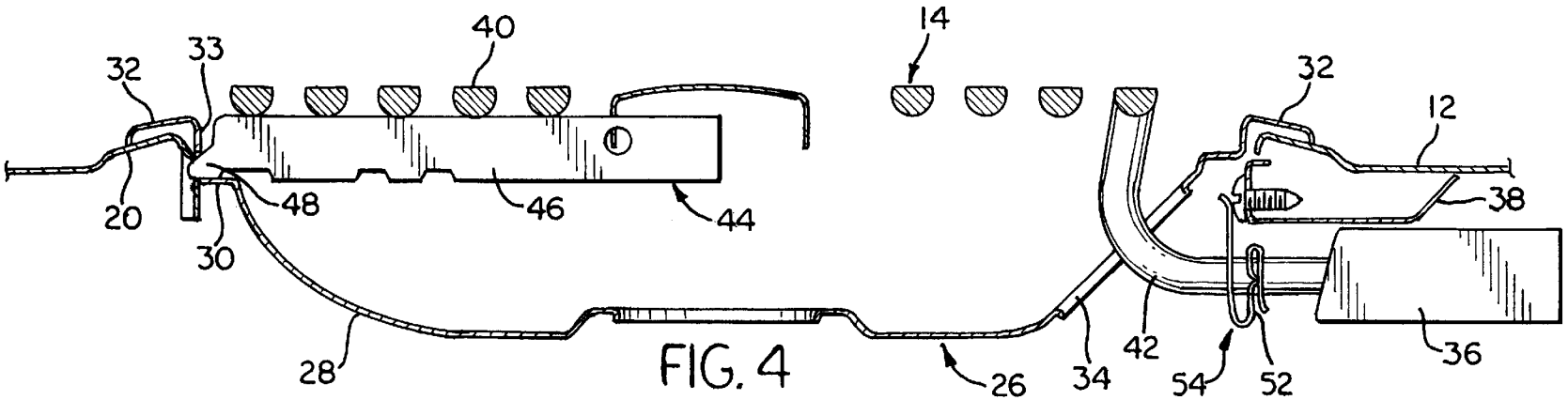
FIG. 4 is a sectional view substantially identical to FIG. 3, except that the heating element is shown in a locked position.
Figure 5:
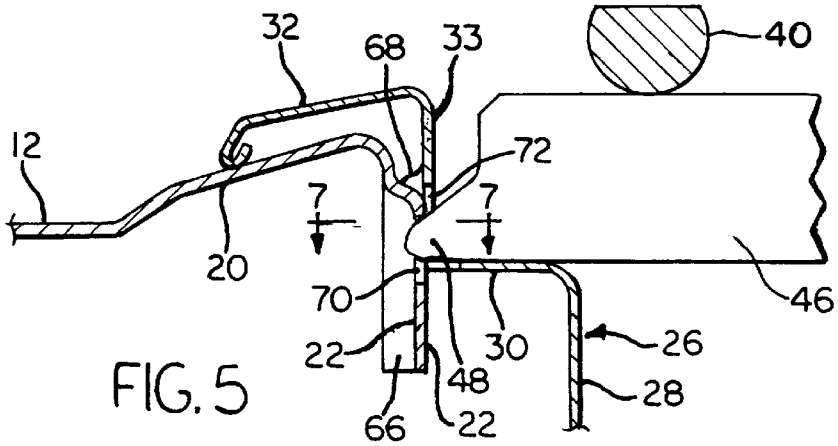
FIG. 5 is an enlarged view showing the left portion of FIG. 4 in greater detail.
Figure 6:
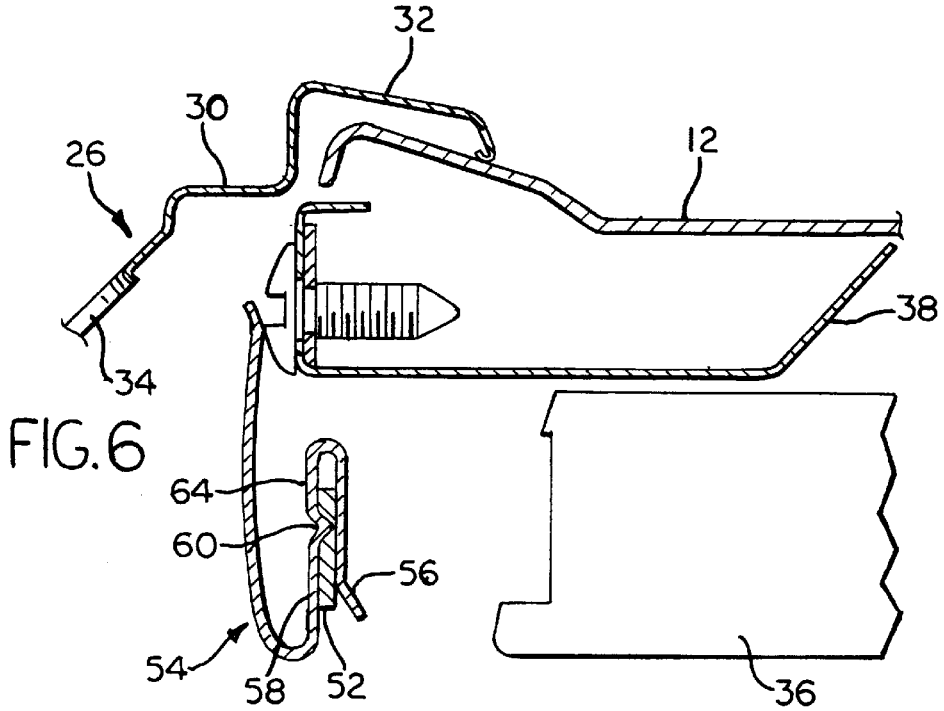
FIG. 6 is an enlarged view showing the right portion of FIG. 4 in greater detail.
Figure 7:
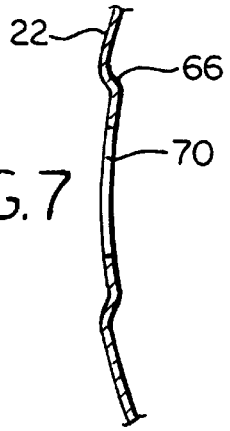
FIG. 7 is a sectional view taken along the line 7—7 of FIG. 5 showing in detail the keyway of the present invention.
Figure 8:
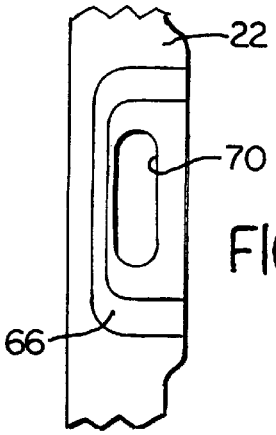
FIG. 8 is an elevational view of the keyway of FIG. 7.

Referring generally to FIGS. 3–8, to assemble the cooktop 10 according to the invention, the pan 26 is disposed within the cooktop opening 24. Preferably, the annular lip 22 and the annular face 33 of the pan both have protrusions 66 and 68, respectively, in which keyway openings 70 and 72 are formed, respectively (FIGS. 5, 7, and 8). The protrusions 66 and 68 are used as indexes to align the pan relative to the cooktop so that the receptacle opening 34 is aligned with the receptacle 36 and that the keyway opening 70 (FIGS. 5 and 8) is aligned with keyway opening 72. Once the pan is aligned and mounted to the cooktop 10, the heating element 14 is then mounted to the cooktop 10 holding the heating element 14 at an angle relative to the cooktop and inserting the electrical terminals 42 through the receptacle opening 34 of the pan. The terminals are then pushed into the receptacle block 36 as the heating coil 40 is then pivoted downwardly until the legs 46 of the spider 44 rest on the annular shoulder 30 of the pan 26.

As the heating element 14 is inserted into the receptacle block 36, the spring arm 64 abuts the annular lip 22 of the cooktop 10. Upon further insertion of the heating element 14 and the rotation of the heating element 14 to seat the legs 46 of the spider 44 on the annular shoulder 30 of the pan 26, the spring arm 64 is further biased away from its rest position. For the nose 48 to be received within the aligned keyways 70, 72, it is necessary for the user to push the electrical terminals 42 of the heating element 14 a sufficient distance into the receptacle block 36 so that the nose 48 will clear the annular lip 32 of the pan 26 as the heating element 14 is rotated. Once the nose has cleared, the legs of the spider 44 are seated on the annular shoulder 30 of the pan 26, and the nose 48 is aligned with the keyways 70 and 72. This position is referred to as the unlocked position and is illustrated in FIG. 3. The user can release their hold on the heating element 14 and the spring force of the deflected spring arm 64 will urge the nose 48 into the keyway 70, 72 (FIG. 6). In this position, an upper edge forming the sloped surface of the nose is wedged against the upper edge of the keyways 70, 72 to lock the leg 46 to the cooktop 10 (FIG. 4). Although the invention is illustrated with the nose passing through both the cooktop 10 and the pan 26, it is within the scope of the invention for the nose to pass through only one of the pan 26 or the cooktop 10. However, it is preferred that the nose pass through the cooktop so as to provide a better lock between the heating element and the cooktop because in many cooktop constructions the pan is not independently locked to the cooktop.

Preferably, the angle of the nose as defined by the sloped top edge and the substantially horizontal bottom edge of the leg 46 is selected to provide the desired amount of holding force in the rotational and vertical directions. Another factor that must be considered when selecting the nose angle is that the smaller the nose angle, the greater becomes the distance that the heating element must travel in the plane of the cooktop to wedge the nose within the keyway 70, 72. Too great of travel in the plane of the cooktop is undesirable for the heating element 14 because it can result in the heating element being off center with respect to the cooktop opening 24 when locked, which is aesthetically displeasing for the user. It has been found that a nose angle between 25 degrees and 60 degrees is preferred.

Unlike previous attempts to hold the heating element 14 in position relative to the cooktop 10, the invention provides a simple method in which the spring force associated with a biasing device, such as the clip, is used to wedge the nose on one leg of the spider into a keyway in the cooktop or the pan and provide sufficient force to hold the heating element in a fixed position relative to the plane of the cooktop and vertical movement away from the plane of the cooktop. Advantageously, the nose is received within the cooktop to effectively lock the heating element 14 to the cooktop. Additionally, the constant force applied by the biasing device maintains the nose in a wedge position relative to the cooktop. The locking of the heating element 14 and the constant pressure by the biasing device results in the heating element being fixed relative to the cooktop in resisting movement of the heating element in response to all forces typically encountered by the heating element during normal use and shipping. The elimination of the rattling of the heating element during normal use and the dislodging of the heating element during shipping results in a higher quality cooktop as perceived by the user and reduced damage during shipping.

We claim:

1. An electric cooktop with a locking heating element, the locking heating element comprising:

a key sized to be received within a keyway in the cooktop;

a biasing device disposed between and abutting the heating element and the cooktop to bias the key into the keyway whereby the heating element is locked in place to prevent rotational and vertical movement thereof relative to the cooktop;

a heating coil and a spider support, the spider support having multiple legs one of which terminates in a nose to form the key;

said nose is partially defined by a bottom edge and a leading edge and the leading edge forms an acute angle relative to the bottom edge; said acute angle is less than 60 degrees;

said biasing device is a spring mounted to the heating coil substantially opposite the nose to bias the nose into the keyway; and said heating coil includes two electrical terminals connected by a retainer strap and the spring is a spring clip mounted on the retainer strap.

2. An electric cooktop as claimed in claim 1, wherein the cooktop includes an electrical receptacle in which the electrical terminals are received to mount the heating coil to the cooktop and the spring clip abut the electrical receptacle to bias the nose into the keyway.

3. An electric cooktop with a locking heating element, the locking heating element comprising:

a key sized to be received within a keyway in the cooktop;

a biasing device disposed between and abutting the heating element and the cooktop to bias the key into the keyway whereby the heating element is locked in place to prevent rotational and vertical movement thereof relative to the cooktop;

said biasing device is a spring mounted to the heating coil substantially opposite the nose to bias the nose into the keyway; and said heating coil includes two electrical terminals connected by a retainer strap and the spring is a spring clip mounted on the retainer strap.

4. An electric cooktop as claimed in claim 3, wherein the spring clip has a tang and the strap has a detent for receiving the tang to secure the clip to the strap.

5. An electric cooktop as claimed in claim 4, wherein the cooktop includes an electrical receptacle in which the electrical terminals are received to mount the heating coil to the cooktop and the spring clip abut the electrical receptacle to bias the nose into the keyway.

* * * * *